US010361039B2

(12) United States Patent
Ishikawa et al.

(10) Patent No.: US 10,361,039 B2
(45) Date of Patent: Jul. 23, 2019

(54) ELECTRODE MATERIAL AND METHOD FOR MANUFACTURING ELECTRODE MATERIAL

(71) Applicant: MEIDENSHA CORPORATION, Tokyo (JP)

(72) Inventors: Keita Ishikawa, Tokyo (JP); Kenta Yamamura, Numazu (JP); Kosuke Hasegawa, Numazu (JP); Shota Hayashi, Tokyo (JP); Takaaki Furuhata, Shizuoka (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 15/751,595

(22) PCT Filed: Aug. 10, 2016

(86) PCT No.: PCT/JP2016/073567
§ 371 (c)(1),
(2) Date: Feb. 9, 2018

(87) PCT Pub. No.: WO2017/026509
PCT Pub. Date: Feb. 16, 2017

(65) Prior Publication Data

US 2018/0240612 A1 Aug. 23, 2018

(30) Foreign Application Priority Data

Aug. 11, 2015 (JP) ..... 2015-158622

(51) Int. Cl.
*H01H 33/662* (2006.01)
*H01H 1/02* (2006.01)
(Continued)

(52) U.S. Cl.
CPC ..... *H01H 1/0206* (2013.01); *B22F 3/26* (2013.01); *C22C 1/04* (2013.01); *C22C 5/04* (2013.01);
(Continued)

(58) Field of Classification Search
CPC .... H01H 1/0206; H01H 1/0203; H01H 33/16; H01H 33/32; H01H 33/34; H01H 33/38;
(Continued)

(56) References Cited

U.S. PATENT DOCUMENTS 3,818,163 A * 6/1974 Robinson ..... C22C 1/0475 200/264
4,190,753 A * 2/1980 Gainer ..... C22C 1/0425 218/130
(Continued)

FOREIGN PATENT DOCUMENTS

CN 103038376 A 4/2013
EP 2 586 882 A1 5/2013
(Continued)

OTHER PUBLICATIONS

Chinese Office Action and English translation, dated Oct. 8, 2018, 13 pages.
Extended European Search Report, dated Nov. 29, 2018, 6 pages.

*Primary Examiner* — Truc T Nguyen
(74) *Attorney, Agent, or Firm* — Foley & Lardner LLP

(57) ABSTRACT

It is an electrode material that is used as an electrode contact of a vacuum interrupter and that contains one or more parts by weight of a heat-resistant element and one part by weight of Cr, the remainder being Cu and an unavoidable impurity. A part of Cr powder and the heat-resistant element powder are mixed together, and this mixed powder is sintered such that a peak corresponding to Cr element disappears in X-ray diffraction measurement. A solid solution powder obtained by pulverizing a sintered body of the heat-resistant element
(Continued)

and Cr obtained by the sintering is mixed with the remaining Cr powder, and this mixed powder is shaped and then sintered. A sintered body obtained by this sintering is infiltrated with Cu.

8 Claims, 4 Drawing Sheets

(51) Int. Cl.

| | |
|---|---|
| ***B22F 3/26*** | (2006.01) |
| ***C22C 1/04*** | (2006.01) |
| ***C22C 5/04*** | (2006.01) |
| ***C22C 9/00*** | (2006.01) |
| ***C22C 9/10*** | (2006.01) |
| ***C22C 14/00*** | (2006.01) |
| ***C22C 16/00*** | (2006.01) |
| ***C22C 25/00*** | (2006.01) |
| ***C22C 27/02*** | (2006.01) |
| ***C22C 27/04*** | (2006.01) |
| ***C22C 27/06*** | (2006.01) |
| ***C22C 30/02*** | (2006.01) |
| ***H01H 33/664*** | (2006.01) |
| ***H01H 11/04*** | (2006.01) |

(52) U.S. Cl.
CPC ..... *C22C 9/00* (2013.01); *C22C 9/10* (2013.01); *C22C 14/00* (2013.01); *C22C 16/00* (2013.01); *C22C 25/00* (2013.01); *C22C 27/02* (2013.01); *C22C 27/04* (2013.01); *C22C 27/06* (2013.01); *C22C 30/02* (2013.01); *H01H 11/048* (2013.01); *H01H 33/662* (2013.01); *H01H 33/664* (2013.01); *B22F 2301/20* (2013.01); *B22F 2304/10* (2013.01)

(58) Field of Classification Search
CPC ..... H01H 33/596; H01H 33/66261; H01H 33/6644; H01H 11/04; H01H 1/06; H01H 2033/66269; H01H 2033/66284; H01H 2201/004
See application file for complete search history.

(56) References Cited

U.S. PATENT DOCUMENTS

| | | | | | |
|---|---|---|---|---|---|
| 4,554,425 | A * | 11/1985 | Kashiwagi | H01H 1/0206 | 200/262 |
| 4,584,445 | A * | 4/1986 | Kashiwagi | H01H 1/0203 | 200/265 |
| 4,626,282 | A * | 12/1986 | Naya | H01H 1/0203 | 200/265 |
| 4,659,885 | A * | 4/1987 | Kashiwagi | H01H 33/6643 | 218/130 |
| 4,686,338 | A * | 8/1987 | Kashiwagi | H01H 1/0206 | 200/262 |
| 4,743,718 | A * | 5/1988 | Santilli | H01H 1/0206 | 200/265 |
| 4,777,335 | A * | 10/1988 | Okutomi | C22C 1/0475 | 200/264 |
| 5,500,499 | A * | 3/1996 | Seki | H01H 1/0203 | 218/123 |
| 5,726,407 | A * | 3/1998 | Okutomi | H01H 1/0203 | 218/130 |
| 6,080,952 | A * | 6/2000 | Okutomi | H01H 33/6644 | 218/118 |
| 2002/0068004 | A1 | 6/2002 | Doh et al. | | |
| 2013/0199905 | A1 | 8/2013 | Noda et al. | | |
| 2015/0200059 | A1* | 7/2015 | Noda | C22C 1/0425 | 218/132 |
| 2015/0206677 | A1* | 7/2015 | Campbell | B22F 1/00 | 218/136 |
| 2016/0141124 | A1* | 5/2016 | Pohle | H01H 11/04 | 419/18 |
| 2016/0332231 | A1 | 11/2016 | Ishikawa et al. | | |
| 2016/0369373 | A1* | 12/2016 | Kitakizaki | B22F 3/26 | |

FOREIGN PATENT DOCUMENTS

| | | | |
|---|---|---|---|
| EP | 3 106 249 | A1 | 12/2016 |
| EP | 3 106 534 | A1 | 12/2016 |
| JP | 4-334832 | A | 11/1992 |
| JP | 2002-180150 | A | 6/2002 |
| JP | 2003-226904 | A | 8/2003 |
| JP | 2012-7203 | A | 1/2012 |
| JP | 2015-138682 | A | 7/2015 |
| WO | WO-2015/111423 | A1 | 7/2015 |

* cited by examiner

ELECTRODE MATERIAL AND METHOD FOR MANUFACTURING ELECTRODE MATERIAL

TECHNICAL FIELD

The present invention relates to an electrode material, which is used for an electrode of vacuum interrupters, etc., and to a method for manufacturing the electrode material.

BACKGROUND ART

In recent years, the use conditions of vacuum interrupter users have become severe, and the expansion of applying vacuum interrupters to capacitor circuits has been progressing. In capacitor circuits, the voltage that is the double or triple of normal voltage is applied between the electrodes. With this, the contact surface tends to be considerably damaged by arc at the time of the current breaking and the current opening and closing, and reignition of arc tends to occur. Therefore, there is an increasing demand for electrode materials having breaking capabilities and withstand voltage capabilities, superior to those of conventional Cu—Cr electrode materials.

For example, in Patent Publication 1, there is described a method for producing an electrode material, in which, as a Cu—Cr based electrode material excellent in electrical characteristics such as current breaking capability and withstand voltage capability, respective powders of Cu used as a base material, Cr for improving electrical characteristics, and a heat-resistant element (Mo, W, Nb, Ta, V, Zr) for making the Cr particles finer are mixed together, and then the mixed powder is put into a mold, followed by pressure forming and making a sintered body. Specifically, a heat-resistant element, such as Mo, W, Nb, Ta, V or Zr, is added to a Cu—Cr based electrode material containing as a raw material a Cr having a particle size of 200-300 μm, and the Cr is made fine through a fine texture technology, an alloying process of the Cr element and the heat-resistant element is accelerated, the precipitation of fine Cr—X (Cr making a solid solution with the heat-resistant element) particles in the inside of the Cu base material texture is increased, and the Cr particles having a diameter of 20-60 μm in a configuration to have the heat-resistant element in its inside are uniformly dispersed in the Cu base material texture. Furthermore, in Patent Publication 1, there is a description that it is important to increase the content of the Cr or the heat-resistant element in the Cu base material in the Cu based electrode material and to conduct a uniform dispersion after making the particle size of Cr, etc. fine, in order to improve electrical characteristics such as current breaking capability and withstand voltage capability in electrode materials for vacuum interrupters.

Furthermore, in Patent Publication 2, without going through the fine texture technology, a powder obtained by pulverizing a single solid solution that is a reaction product of a heat-resistant element is mixed with a Cu powder, and this mixed powder is subjected to pressure forming and then sintering to produce an electrode material containing Cr and the heat-resistant element in the electrode texture.

Furthermore, in Patent Publication 3, the mixing ratio of Mo powder to Cr powder is made to be Mo:Cr=1:1 to 9:1, Mo is made to be equal to or greater than Cr in mixing weight, and they are uniformly mixed together, thereby producing an electrode material that has a fine texture although it is a MoCr alloy's composite texture high in arc-resistant component content. Such electrode material is capable of improving breaking capability of vacuum interrupters. Furthermore, since it is possible to further increase electrode material's hardness, it is mentioned that vacuum interrupter's withstand voltage and/or capacitor's opening and closing capability can also be improved.

PRIOR ART PUBLICATIONS

Patent Publications

Patent Publication 1: JP Patent Application Publication 2002-180150.
Patent Publication 2: JP Patent Application Publication Heisei 4-334832.
Patent Publication 3: JP Patent Application Publication 2012-7203.

SUMMARY OF THE INVENTION

The inventors have made a further study on the electrode material according to Patent Publication 3. As a result, we have confirmed that breaking capability is good by making an electrode material have a conductivity of 28% IACS or higher by the Mo/Cr mixing ratio.

An electrode material having a conductivity of 28% IACS or higher is, however, increased in hardness and contact resistance between electrodes. In the case of making a vacuum interrupter using such electrode material, it is necessary to increase contact pressure of an actuator for conducting an opening-closing operation of the electrodes. As a result, it increases costs of the actuator, and this has been a problem in mass production.

In view of the above situation, it is an object of the present invention to provide a technique that contributes to the improvement of breaking capability and the reduction of contact resistance of vacuum interrupters.

According to one aspect of an electrode material of the present invention for achieving the above object, there is provided an electrode material that contains one or more parts by weight of a heat-resistant element and one part by weight of Cr, a remainder of the electrode material being Cu and an unavoidable impurity. The electrode material is prepared by mixing a Cr powder with a solid solution powder of the heat-resistant element and Cr, the solid solution powder being free from a peak corresponding to Cr element in an X-ray diffraction measurement, thereby obtaining a mixed powder; shaping the mixed powder into a shaped mixed powder; sintering the shaped mixed powder, thereby obtaining a sintered body; and infiltrating the sintered body with Cu.

Furthermore, according to another aspect of an electrode material of the present invention for achieving the above object, in the electrode material, an average particle size of the solid solution powder is less than 30 μm.

Furthermore, according to another aspect of an electrode material of the present invention for achieving the above object, in the electrode material, an average particle size of the Cr powder to be mixed with the solid solution powder is 10 to 80 μm.

Furthermore, according to another aspect of an electrode material of the present invention for achieving the above object, in the electrode material, a weight ratio of the heat-resistant element to the Cr in the sintered body subjected to the infiltration with the Cu is 1:1 to 6:1.

Furthermore, according to one aspect of a method for manufacturing an electrode material of the present invention for achieving the above object, there is provided a method for manufacturing an electrode material that contains one or more parts by weight of a heat-resistant element and one part by weight of Cr, a remainder of the electrode material being Cu and an unavoidable impurity. In the method, a heat-resistant element powder is mixed with a Cr powder that contains Cr of a weight less than a weight of Cr contained in the electrode material, thereby obtaining a mixed powder; the mixed powder is sintered to produce a sintered body containing a solid solution of the heat-resistant element and the Cr such that a peak corresponding to Cr element disappears in an X-ray diffraction measurement; the sintered body containing the solid solution of the heat-resistant element and the Cr is pulverized, thereby obtaining a solid solution powder; the solid solution powder is mixed with a Cr powder that contains Cr of a weight obtained by subtracting the weight of the Cr contained in the Cr powder to be mixed with the heat-resistant element powder from the weight of Cr contained in the electrode material; the mixed powder of the solid solution powder and the Cr powder obtained by the mixing is shaped and then sintered; and the sintered body obtained by the sintering is infiltrated with Cu.

Furthermore, according to one aspect of a vacuum interrupter of the present invention for achieving the above object, a fixed electrode or a movable electrode is equipped with an electrode contact comprising the above electrode material.

MODE FOR IMPLEMENTING THE INVENTION

Figure 1:
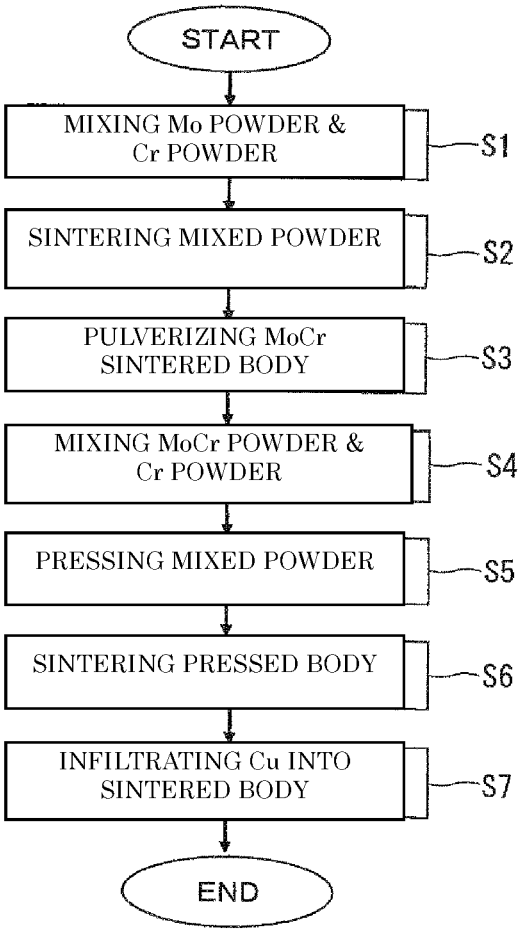
FIG. 1 is a flowchart of an electrode material manufacturing method according to an embodiment of the present invention.

An electrode material and an electrode material manufacturing method according to an embodiment of the present invention and a vacuum interrupter according to an embodiment of the present invention are explained in detail with reference to the drawings. In the explanation of the embodiment, unless otherwise stated, the average particle size refers to the value determined by a laser diffraction-type, particle size distribution measurement apparatus (a company CILAS; CILAS 1090L). Furthermore, in case that the upper limit (or lower limit) of the particle size of a powder is defined, it refers to a powder classified by a sieve having an opening of the upper limit value (or lower limit value) of the particle size.

The present invention is an invention related to a composition control technique of a Cu—Cr-heat resistant element (Mo, W, V, etc.) electrode material. It improves withstand voltage capability, breaking capability and vacuum interrupter (or capacitor) opening-closing capability by mixing a Cr powder with a solid solution powder of a heat-resistant element and Cr, the solid solution powder being previously free from a peak corresponding to Cr element in an X-ray diffraction measurement, and then infiltrating a sintered body of the obtained mixed powder with Cu, as compared with conventional electrodes (Cu—Cr-heat resistant element electrodes). According to an electrode material of the present invention, it is possible to open and close a vacuum interrupter with a low pressure.

As the heat-resistant element, an element selected from elements, such as molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rf) and ruthenium (Ru), can be used singly or in combination. In particular, it is preferable to use Mo, W, Ta, Nb, V or Zr, which is remarkable in the effect of making the Cr particles fine. The heat-resistant element is added to the electrode material such that the weight ratio of the heat-resistant element to Cr becomes 1 or more. In the case of using the heat-resistant element as a powder, it is possible to make Cr-containing particles (containing a solid solution of the heat-resistant element and Cr) fine and uniformly disperse them in the electrode material by adjusting the average particle size of the heat-resistant element powder, for example, to 2 to 20 μm, more preferably 2 to 10 μm.

Chromium (Cr) is added to the electrode material such that the weight ratio of the heat-resistant element to Cr becomes 1 or more. In the case of using a Cr powder, it is possible to obtain an electrode material that is superior in withstand voltage capability and current breaking capability by adjusting the Cr powder's particle size to, for example, −48 mesh (a particle size of less than 300 μm), more preferably −100 mesh (a particle size of less than 150 μm), still more preferably −325 mesh (a particle size of less than 45 μm). This is because conductivity may increase unnecessarily by increasing the average particle size of Cr powder and there is a risk of lowering withstand voltage capability of an electrode material if conductivity exceeds 40% IACS.

Copper (Cu) is infiltrated into a sintered body prepared by sintering the heat-resistant element and Cr (containing a solid solution of the heat-resistant element and Cr). The amount of Cu to be contained in the electrode material is determined by the infiltration step. Therefore, the total weight % of the heat-resistant element, Cr and Cu to be added to the electrode material never exceeds 100 weight %.

The electrode material manufacturing method according to an embodiment of the present invention is explained in detail with reference to flow of FIG. 1. The explanation of the embodiment is conducted by showing Mo as an example of the heat-resistant element, but it is similar in the case of using another heat-resistant element powder, too.

In Mo—Cr mixing step S1, the heat-resistant element powder (e.g., Mo powder) is mixed with Cr powder. The Mo powder and the Cr powder are mixed together such that Cr is completely dissolved. The Mo powder and the Cr powder are mixed together, for example, in a weight ratio of Mo:Cr=7:1 to 9:1. This is because Cr tends to remain in the MoCr solid solution in the case of using a mixed powder of Mo powder and Cr powder, in which the weight ratio of Mo to Cr is roughly 6 or less, in the MoCr solid solution prepared by sintering a mixed powder of Mo powder and Cr powder.

In preliminary sintering step S2, the mixed powder of Mo powder and Cr powder is put into a container (for example, alumina container) that does not react with Mo and Cr, and then a preliminary sintering is conducted in a non-oxidative atmosphere (hydrogen atmosphere, vacuum atmosphere, etc.) at a predetermined temperature (for example, 1250° C. to 1500° C.). By conducting the preliminary sintering, it is possible to obtain a MoCr solid solution in which Mo and Cr are dissolved and diffused into each other. In preliminary sintering step S2, sintering of a mixed powder of Mo powder and Cr powder is conducted to obtain a solid solution of Mo and Cr, the solid solution being free from a peak corresponding to Cr element in an X-ray diffraction measurement (that is, a solid solution where Cr is completely dissolved).

In pulverization step S3, the MoCr solid solution obtained by preliminary sintering step S2 is pulverized by a ball mill, etc. to obtain a MoCr powder containing the MoCr solid solution. The MoCr solid solution is pulverized such that, for example, the average particle size becomes less than 30 μm, more preferably 10-30 μm (30 μm is not included). Pulverization step S3 may be conducted in the air as the pulverization atmosphere, but it is desirable to conduct the pulverization in a non-oxidative atmosphere.

In MoCr—Cr mixing step S4, the MoCr powder obtained by pulverization step S3 is mixed with Cr powder. This Cr powder may be the Cr powder used in Mo—Cr mixing step S1 or another Cr powder separately prepared. For example, a Cr powder having an average particle size of 10 to 80 μm is mixed with the MoCr powder.

In press forming step S5, forming of the mixed powder of the MoCr powder and the Cr powder is conducted. Forming of the mixed powder of the MoCr powder and the Cr powder is conducted by press forming at a pressure of, for example, 1 to 4 t/cm$^2$.

In primary sintering step S6, a primary sintering of a compact (MoCr—Cr compact) obtained by press forming step S5 is conducted to obtain a MoCr—Cr sintered body (MoCr—Cr skeleton). The primary sintering is conducted, for example, by sintering the MoCr—Cr compact at 1150° C. for 2 hours in a vacuum atmosphere. Primary sintering step S6 is a step to obtain a compact MoCr—Cr sintered body by the Cr powder's modification and its adhesion to the MoCr powder. It is desirable to conduct the sintering of the MoCr—Cr compact under the temperature condition of the next infiltration step S7, for example, at a temperature of 1150° C. or higher. If the sintering is conducted at a temperature lower than the infiltration temperature, a gas contained in the MoCr—Cr sintered body is newly generated at the Cu infiltration and remains in the Cu-infiltrated body, thereby causing damage on withstand voltage capability and current breaking capability. Therefore, the MoCr particles (Cr particles) become more compact and degassing of the MoCr particles (Cr particles) proceeds sufficiently by adjusting the sintering temperature of primary sintering step S6 to a temperature that is higher than that at the Cu infiltration and is lower than melting point of Cr, preferably in a range of 1100 to 1500° C.

In Cu infiltration step S7, the MoCr—Cr sintered body is infiltrated with Cu. The Cu infiltration is conducted, for example, by placing a Cu plate member on the MoCr—Cr sintered body and then maintaining it in a non-oxidative atmosphere at a temperature that is melting point of Cu or higher for a predetermined time (for example, 1150° C. and two hours).

Figure 2:
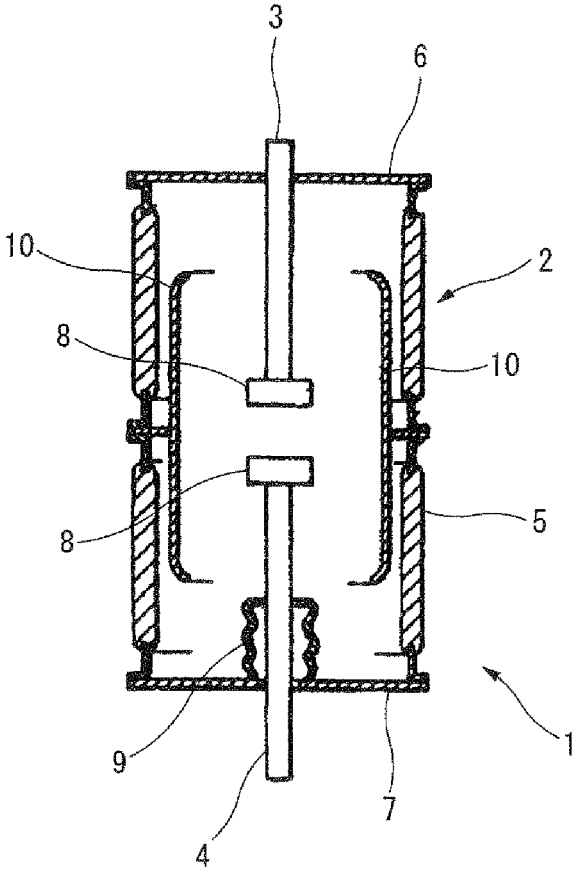
FIG. 2 is a schematic sectional view showing a vacuum interrupter having the electrode material according to the embodiment of the present invention.

By using the electrode material according to the embodiment of the present invention, it is possible to construct a vacuum interrupter. As shown in FIG. 2, a vacuum interrupter 1 having the electrode material according to the embodiment of the present invention has a vacuum container 2, a fixed electrode 3, a movable electrode 4, and a main shield 10.

The vacuum container 2 is formed by sealing both opening end portions of an insulating sleeve 5 with a fixed-side end plate 6 and a movable-side end plate 7, respectively.

The fixed electrode 3 is fixed in a condition that it passes through the fixed-side end plate 6. One end of the fixed-side electrode 3 is fixed to be opposed to one end of the movable electrode 4 in the vacuum container 2. An end portion of the fixed electrode 3, which is opposed to the movable electrode, is formed with an electrode contact material 8, which is the electrode material according to the embodiment of the present invention.

The movable electrode 4 is provided at the movable-side end plate 7. The movable electrode 4 is provided to be coaxial with the fixed electrode 3. The movable electrode 4 is moved in an axial direction by an opening/closing means not shown in the drawings, thereby conducting an opening or closing between the fixed electrode 3 and the movable electrode 4. An end portion of the movable electrode 4, which is opposed to the fixed electrode 3, is formed with an electrode contact material 8. Bellows 9 are provided between the movable electrode 4 and the movable-side end plate 7. Therefore, while vacuum of the inside of the vacuum container 2 is maintained, the movable electrode 4 is moved in a vertical direction to conduct an opening/closing between the fixed electrode 3 and the movable electrode 4.

The main shield 10 is provided to cover a contact portion between the electrode contact material 8 of the fixed electrode 3 and the electrode contact material 8 of the movable electrode 4, thereby protecting the insulating sleeve 5 from an arc that occurs between the fixed electrode 3 and the movable electrode 4.

EXAMPLE 1

As the electrode material of Example 1, an electrode material was produced in accordance with the flow of FIG. 1. The electrode material of Example 1 is an electrode material containing Mo and Cr in a weight ratio of Mo:Cr=1:1.

In producing the electrode material of Example 1, a Mo powder having an average particle size of 10 μm or less was used as the Mo powder. Furthermore, as the Cr powders, a Cr powder having an average particle size of 63 μm or less was used in Mo—Cr mixing step S1, and a Cr powder having an average particle size of 39 μm was used in MoCr—Cr mixing step S4.

Firstly, Mo powder and Cr powder were mixed together in a weight ratio of Mo:Cr=9:1 (step S1). The obtained mixed powder was sintered at 1250° C. for three hours, thereby obtaining a MoCr solid solution in which Cr is completely dissolved (step S2). The obtained MoCr solid solution was pulverized by a ball mill into a MoCr powder (step S3). The average particle size of the MoCr powder was 20 μm.

Next, the MoCr powder and the Cr powder were uniformly mixed together such that the weight ratio of Mo:Cr became 1:1 (step S4). The obtained mixed powder was subjected to press forming at 4 t/cm$^2$ (step S5). The obtained compact was maintained at a temperature of 1100 to 1200° C. for 1 to 2 hours to conduct the primary sintering (step S6).

A Cu thin plate was disposed on the obtained MoCr—Cr sintered body, and then it was maintained at a temperature of 1100 to 1200° C. for 1 to 2 hours, thereby infiltrating the MoCr—Cr sintered body with Cu through liquid phase sintering (step S7).

As shown in Table 1, as conductivity of the electrode material of Example 1 was measured, it was 28% IACS. Furthermore, as Vickers hardness of the electrode material surface of Example 1 was measured, it was 380.

TABLE 1

| | Mo:Cr content ratio [Mo:Cr] | MoCr alloy powder use | Added Cr powder [average particle size] | Conductivity [% LACS] | Hardness [HV] |
|---|---|---|---|---|---|
| Com. Ex. 1 | 1:1 | No | 64 | 22 | 524 |
| Com. Ex. 2 | 3:1 | No | 64 | 30 | 321 |
| Com. Ex. 3 | 9:1 | No | 64 | 32 | 253 |
| Example 1 | 1:1 | Yes | 39 | 28 | 380 |
| Example 2 | 3:1 | Yes | 39 | 35 | 293 |
| Example 3 | 3:1 | Yes | 64 | 35 | 284 |

EXAMPLE 2

The electrode material of Example 2 is an electrode material containing Mo and Cr in a weight ratio of Mo:Cr=3:1. That is, the electrode material of Example 2 is an electrode material prepared by the same method as that of the electrode material of Example 1, except in that MoCr powder and Cr powder were mixed together in MoCr—Cr mixing step S4, thereby achieving a weight ratio of Mo:Cr=3:1.

As shown in Table 1, conductivity of the electrode material of Example 2 was 35% IACS, and Vickers hardness of the electrode material surface of Example 2 was 293.

EXAMPLE 3

The electrode material of Example 3 is an electrode material prepared by the same method as that of the electrode material of Example 2, except in that the average particle size of the Cr powder to be mixed with the MoCr powder in MoCr—Cr mixing step S4 was different. The electrode material of Example 3 is an electrode material prepared by mixing together MoCr powder (average particle size: 20 μm) and Cr powder (average particle size: 64 μm).

As shown in Table 1, conductivity of the electrode material of Example 3 was 35% IACS, and Vickers hardness of the electrode material surface of Example 3 was 284.

COMPARATIVE EXAMPLE 1

Figure 3:
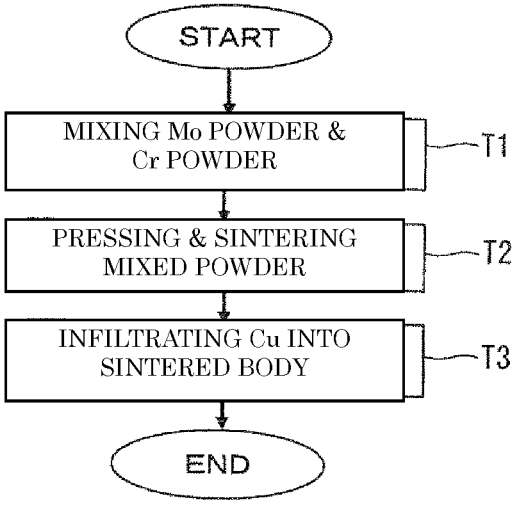
FIG. 3 is a flowchart of an electrode material manufacturing method according to Comparative Example 1.

The electrode material of Comparative Example 1 is an electrode material prepared in accordance with the flow shown in FIG. 3. In Comparative Example 1, an electrode material was prepared by using a Mo powder having an average particle size of 10 μm or less and a Cr powder having an average particle size of 64 μm.

Firstly, Mo powder and termite Cr powder were mixed together in a weight ratio of Mo:Cr=1:1 (step T1). The obtained mixed powder was subjected to press forming at 4 t/cm$^2$, and the obtained compact was maintained at a temperature of 1100 to 1200° C. for 1 to 2 hours to achieve the primary sintering (step T2).

A Cu thin plate was disposed on the sintered body obtained by step T2, and it was maintained at a temperature of 1100 to 1200° C. for 1 to 2 hours to infiltrate the sintered body with Cu through liquid phase sintering (step T3).

As shown in Table 1, conductivity of the electrode material of Comparative Example 1 was 22% IACS, and Vickers hardness of the electrode material surface was 524.

COMPARATIVE EXAMPLE 2

The electrode material of Comparative Example 2 is an electrode material prepared by the same method as that of the electrode material of Comparative Example 1, except in that the mixing ratio of Mo powder to Cr powder was changed. In Comparative Example 2, an electrode material was prepared by mixing Mo powder and Cr powder in a weight of Mo:Cr=3:1.

As shown in Table 1, conductivity of the electrode material of Comparative Example 2 was 30% IACS, and Vickers hardness of the electrode material surface was 321.

COMPARATIVE EXAMPLE 3

The electrode material of Comparative Example 3 is an electrode material prepared by the same method as that of the electrode material of Comparative Example 1, except in that the mixing ratio of Mo powder to Cr powder was changed. In Comparative Example 3, an electrode material was prepared by mixing Mo powder and Cr powder in a weight of Mo:Cr=9:1.

As shown in Table 1, conductivity of the electrode material of Comparative Example 3 was 32% IACS, and Vickers hardness of the electrode material surface was 253.

As shown in Table 1, the electrode material of Example 1 and the electrode material (an electrode material prepared by a conventional infiltration method) of Comparative Example 1 are electrode materials having the same Mo:Cr content ratio. The electrode material of Example 1 is, however, improved in conductivity and lowered in Vickers hardness, as compared with the electrode material of Comparative Example 1. Similarly, the electrode material of Example 3 and the electrode material of Comparative Example 2 are electrode materials having the same Mo:Cr content ratio. The electrode material of Example 3 is, however, improved in conductivity and lowered in Vickers hardness, as compared with the electrode material of Comparative Example 2. Between the electrode of Comparative Example 1 and the electrode of Example 1, the particle size of Cr powder to be added to MoCr powder is different. However, as it is clear from a comparison between the electrode material of Example 2 and the electrode material of Example 3, it is considered that there is not a considerable change in conductivity and Vickers hardness by the particle size of Cr particles to be added to MoCr powder. Therefore, even if the average particle size of Cr to be added to MoCr powder is adjusted to 64 μm in the electrode material of Example 1, it is considered to be superior in conductivity to the electrode material of Comparative Example 1 and to become an electrode material with a low hardness.

Figure 4:
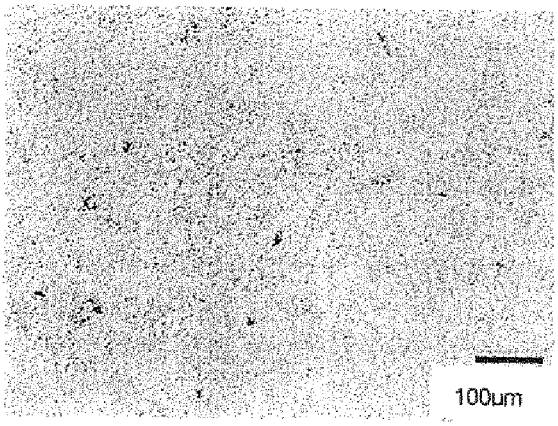
FIG. 4 is a sectional microphotograph of an electrode material according to Example 2.
Figure 5:
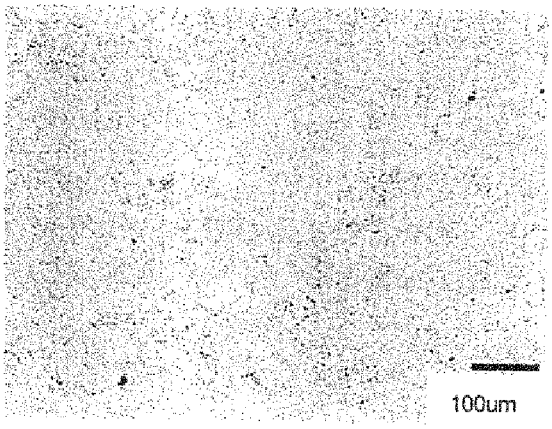
FIG. 5 is a sectional microphotograph of an electrode material according to Example 3.
Figure 6:
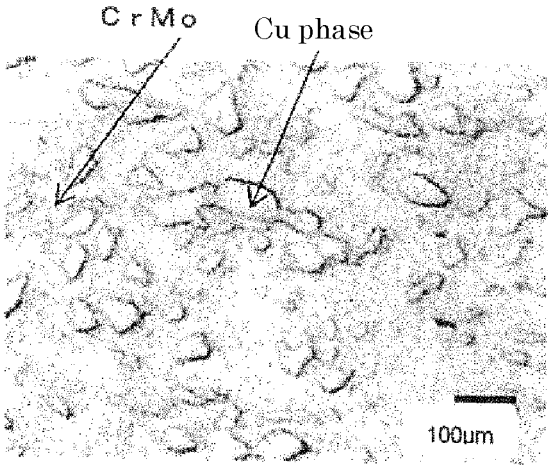
FIG. 6 is a sectional microphotograph of an electrode material according to Comparative Example 1.

Furthermore, cross-sections of Examples 2 and 3 and Comparative Example 2 were observed by a microscope. As shown in FIG. 4, the electrode material of Example 2 was an electrode material in which a fine Cu phase was uniformly distributed throughout the electrode material by the Cu infiltration into MoCr compact spots. Similarly, as shown in FIG. 5, the electrode material of Example 3 was also an electrode material in which a fine Cu phase was uniformly distributed throughout the electrode material. In contrast with this, as shown in FIG. 6, the electrode material of Comparative Example 1 was an electrode material dotted with a relatively large Cu phase (Cu phase depending on the Cr particle size) infiltrated into vacancies generated by refinement of Cr.

That is, in the electrode materials of Example 1 to Example 3, Cu phase formation spots, which Cu phase depends on Cr particle size, in the sintering parent material of MoCr are reduced by infiltrating Cu having a good wettability with the sintered body, which has been prepared by sintering a mixed powder of MoCr solid solution powder and Cr powder, into gaps of this sintered body, as compared with the case of infiltrating Cu into a sintered body prepared by simply sintering a mixed powder of Mo powder and Cr powder. By infiltrating Cu into MoCr compact spots in the electrode material in this manner, it is considered that a given amount of Cu is assured and that hardness of the electrode material can also be reduced. It is considered to be able to improve conductivity and reduce the electrode material surface hardness, particularly in an electrode material that results in a mixing ratio of the heat-resistant element powder to Cr powder (for example, a weight ratio of heat-resistant element:Cr=1:1 to 6:1, more preferably heat-resistant element:Cr=1:1 to 3:1) such that Cr remains in the case of totally mixing the heat-resistant element powder and Cr as the raw materials.

According to the above-mentioned method for manufacturing an electrode material of the present invention, it is possible, in an electrode material that contains one or more parts by weight of a heat-resistant element and one part by weight of Cr, a remainder of the electrode material being Cu and an unavoidable impurity, to obtain an electrode material that is superior in conductivity and lowered in Vickers hardness by press forming a mixed powder of a solid solution powder prepared by previously dissolving the heat-resistant element and Cr to prevent Cr from remaining and Cr powder and by infiltrating Cu into a sintered body prepared by sintering a compact obtained by the press forming. The electrode material of the present invention is satisfactory in breaking capability due to its high conductivity and is preferable for a vacuum interrupter with a high voltage and a large capacity.

Furthermore, according to the electrode material and the electrode material manufacturing method of the present invention, it is possible to suppress variation of conductivity in the electrode material by uniformly distributing a fine Cu phase throughout the electrode material.

Furthermore, according to the electrode material and the electrode material manufacturing method of the present invention, it is possible to improve conductivity of the electrode material and to lower hardness of the electrode material, without increasing the amount of Mo. As the electrode materials of Comparative Examples 1 to 3 are compared, it is possible to improve conductivity of the electrode material and to lower hardness of the electrode material by increasing the Mo content proportion in the electrode material. However, in an electrode material containing Cu, Cr and a heat-resistant element, there is a tendency that it becomes advantageous in terms of cost and withstand voltage capability by reducing the amount of the heat-resistant element. Therefore, according to the electrode material and the electrode material manufacturing method of the present invention, it is possible to manufacture an electrode material with a low cost that is superior in conductivity and withstand voltage capability and is low in hardness.

Furthermore, it is possible to improve withstand voltage capability and breaking capability of a vacuum interrupter and capacitor's opening and closing capability by using the electrode material of the present invention as an electrode contact material of at least one electrode of a fixed electrode and a movable electrode of a vacuum interrupter.

Furthermore, contact resistance between electrodes of a vacuum interrupter is reduced by using an electrode material low in hardness as an electrode contact member. Therefore, it becomes unnecessary to increase contact pressure of an actuator for driving the movable electrode. With this, it is possible to use an actuator low in price. That is, it is possible to reduce the costs of the vacuum interrupter.

As above, the explanation of the embodiments was conducted by showing preferable modes of the present invention, but the electrode material and the electrode material manufacturing method of the present invention are not limited to the embodiments. It is possible to suitably change the design in a range of not impairing characteristics of the invention, and the embodiment with the changed design also belongs to the technical scope of the present invention.

The invention claimed is:

1. A method for manufacturing an electrode material containing 1) one or more parts by weight of a heat-resistant element that is at least one element of Mo, W, Ta, Nb, V or Zr, and 2) one part by weight of a total Cr that is total of a first Cr and a second Cr, a remainder of the electrode material being Cu and impurity, the method comprising the steps of:

(a) mixing a powder of a solid solution of the heat-resistant element and the first Cr, with a powder of the second Cr, the first Cr being completely dissolved in the solid solution, thereby obtaining a mixed powder;

(b) shaping the mixed powder into a shaped mixed powder;

(c) sintering the shaped mixed powder, thereby obtaining a sintered body; and (d) infiltrating the sintered body with Cu.

2. The method as claimed in claim 1, wherein an average particle size of the solid solution powder is less than 30 μm.

3. The method as claimed in claim 1, wherein an average particle size of the powder of the second Cr to be mixed with the solid solution powder is 10 to 80 μm.

4. The method as claimed in claim 1, wherein a weight ratio of the heat-resistant element to the total Cr in the sintered body subjected to the infiltration with the Cu is 1:1 to 6:1.

5. A method for manufacturing an electrode material containing 1) one or more parts by weight of a heat-resistant element that is at least one element of Mo, W, Ta, Nb, V or Zr, and 2) one part by weight of a total Cr that is a total of a first Cr and a second Cr, a remainder of the electrode material being Cu and an impurity, the method comprising the steps of:

(a) mixing a powder of the heat-resistant element with a powder of the first Cr, thereby obtaining a mixed powder;

(b) sintering the mixed powder of step (a) to produce a sintered body containing a solid solution of the heat-resistant element and the first Cr, the first Cr being completely dissolved in the solid solution;

(c) pulverizing the sintered body containing the solid solution of the heat-resistant element and the first Cr, thereby obtaining a solid solution powder;

(d) mixing the solid solution powder with a powder of the second Cr, thereby obtaining a mixed powder;

(e) shaping the mixed powder of step (d), followed by sintering to obtain a sintered body; and (f) infiltrating the sintered body of step (e) with Cu.

6. The method as claimed in claim 5, wherein an average particle size of the solid solution powder is less than 30 μm.

7. The method as claimed in claim 5, wherein an average particle size of the powder of the second Cr to be mixed with the solid solution powder is 10 to 80 μm.

8. The method as claimed in claim 5, wherein a weight ratio of the heat-resistant element to the total Cr in the sintered body subjected to the infiltration with the Cu is 1:1 to 6:1.

* * * * *